United States Patent [19]

Clay

[11] 4,294,633

[45] Oct. 13, 1981

[54] BLASTING COMPOSITION

[76] Inventor: Robert B. Clay, 728 West 3800 South, Bountiful, Utah 84010

[21] Appl. No.: 46,360

[22] Filed: Jun. 7, 1979

[51] Int. Cl.[3] ..... C06B 45/00

[52] U.S. Cl. ..... 149/2; 149/43; 149/46; 149/60; 149/61

[58] Field of Search ..... 149/61, 43, 2, 46, 60

[56] References Cited

U.S. PATENT DOCUMENTS 4,111,727 9/1978 Clay ..... 149/46 X

*Primary Examiner*—Stephen J. Lechert, Jr.

*Attorney, Agent, or Firm*—Edwin M. Thomas; Richard F. Bojanowski

[57] ABSTRACT

A blasting composition of high solids content, usually of plastic solid consistency, is composed of 60 to 90 parts by weight of solid particulate oxidizer salt, which is mainly ammonium nitrate, preferably fertilizer grade prills, and 10 to 40% of liquid slurry partially filling the interstices and voids in and between the solid particles. The slurry is one that will not appreciably dissolve or soften the granules, hence it is preferably a substantially saturated and thickened solution, in non-aqueous solvent, of strong oxidizer salt, typically ammonium and/or calcium nitrate to which sodium nitrate may be added. The preferred solvent is a low molecular weight polar organic liquid, selected from the group consisting of methanol, ethylene glycol, formamide and ethanol. In some cases isopropanol or propylene glycol may be included. The slurry is of greater density than the bulk granular solids so that it will significantly increase the overall bulk density of the composition which should contain enough dispersed air to improve its sensitivity to detonation over that of a similar composition containing no air filled voids.

14 Claims, 1 Drawing Figure

SOLUBILITY OF AMMONIUM NITRATE

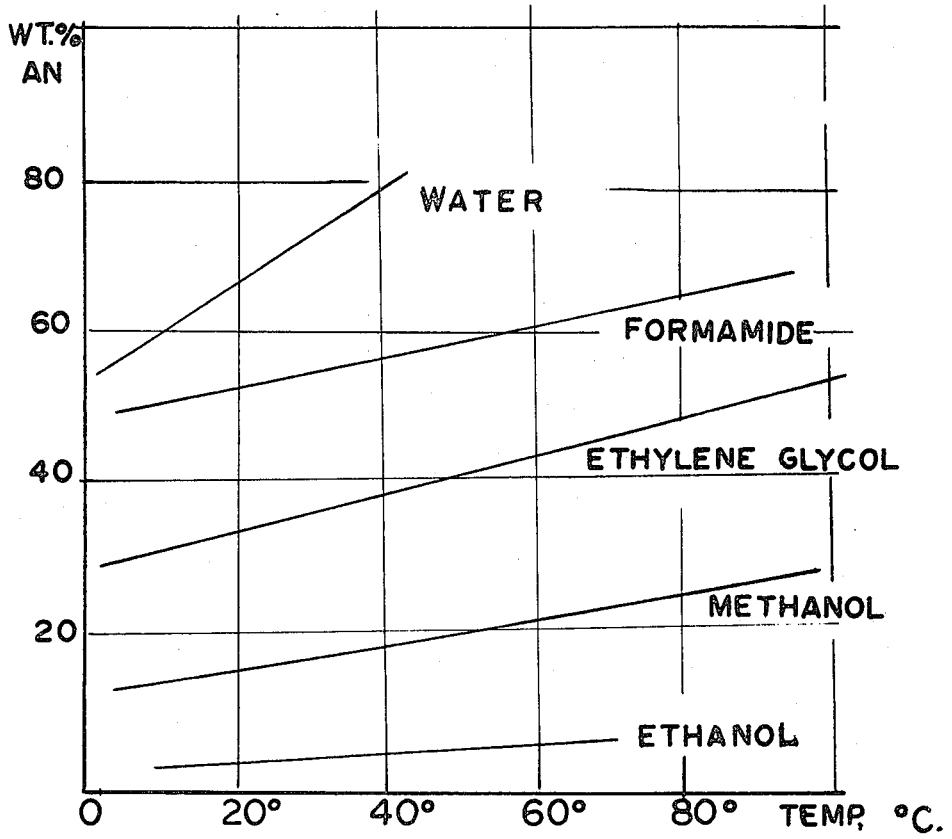
SOLUBILITY OF AMMONIUM NITRATE

BLASTING COMPOSITION

BACKGROUND AND PRIOR ART

Blasting compositions consisting essentially of particulate ammonium nitrate, coated with a small proportion of oil or other fuel, are widely used for blasting purposes because of their low cost. Fertilizer grade ammonium nitrate prills, coated with about 6% of diesel oil or fuel oil is widely used under the general title ANFO (ammonium nitrate fuel oil). These compositions, however, have certain limitations. They are low in water resistance and usually cannot be used in water filled boreholes or in other wet places, requiring that they be packaged in plastic bags to keep them dry. Then their bulk density is usually much less than that of water so they will not sink in a water filled hole without some weighty material being added. They are also hygroscopic so that they will cake and become inert in damp air, even though no actual water is present. Moreover, their bulk blasting energy (Energy per unit of volume) is quite low, requiring that larger diameter bore-holes be bored than would be required for a more powerful explosive. This of course requires larger drills, more power to do the drilling, and adds to blasting costs. Holes as large as 15 inches in diameter are frequently used for ANFO blasting. ANFO has a slower detonation velocity than some other blasting compositions which is an advantage where a heaving action rather than shattering is desired. Some attempts have been made to increase the density of ANFO, as by crushing the granules, or packing them under compression in strong bags but at best a bulk density of about 1 gram/cc. is the maximum that can be obtained, and this under difficulties. Bagged ANFO even of density above 1.0 still will not sink readily in water filled boreholes. In come cases fuels such as ethylene glycol and/or powdered aluminum have been added to increase the density but these add to costs; particulate ferrosilicon or ferrophosphorus, similarly used, are costly too.

Because of the above disadvantages, slurry explosives have come to replace ANFO for wet conditions in many cases because they can be made more dense and they have some temporary water resistance. These usually consist of (1) a thickened or gelled aqueous solution of ammonium nitrate, (2) an added fuel which may comprise fuel oil, liquids such as alcohols, etc., or solid particulate materials such as sulfur, coal, gilsonite, and/or aluminum particles, and (3) some undissolved oxidizer, usually ammonium nitrate, in suspension in the liquid. The slurries may be cross-linked with chemical agents to stabilize their gelled condition and they may be pumped directly into boreholes where, under favorable conditions, they resist water penetration temporarily. They may have a density as high as 1.2 gm./cc, or even higher so they will sink in water. However, they usually contain about 15% or so of water which reduce their weight strength (energy per unit weight) below that of ANFO, usually to about 60 to 80% that of ANFO unless high energy (and costly) fuels such as paint grade aluminum or the like are included.

Another disadvantage of slurries is that at their natural densities they usually will not detonate reliably unless they are sensitized, e.g. aerated by inclusion of finely dispersed gas, either as minute bubbles or enclosed within fine hollow particles such as styrene beads, microspheres of glass filled with air, or the like. Gas bubbles are often generated in situ in the gel, as by decomposing a gas-generated material such as hydrogen peroxide or a nitrite or carbonate salt in the slurry, often requiring close pH control, along with a catalyst to promote gas formation. Although this is effective in some cases, where the explosive is loaded into deep boreholes, with a high hydrostatic load of explosive above, the bottom part of the charge often is so much compressed that the aeration is ineffective and the bottom part of the charge may fail to detonate, even though part of the charge above shoots satisfactorily. In such cases, much more gasing agent or aeration, or the equivalent, must be used at the bottom than at the top and this causes difficulties. The slurry tends to rise out of the water filled hole as it is poured or pumped into place. Highly trained personnel are often required to manage slurry satisfactorily, e.g. by pulling the filling hose up at a carefully controlled rate as the charge is pumped into place, aside from the care required in preparing the explosive mixture. Changes in formulation, from bottom to top of the hole are often required and this requires skilled manipulations. Packaged slurry products often have densities around 1.1 g./cc. and high detonation velocities.

It has been suggested in the prior art that ANFO may be modified by combining other materials with it, to overcome some of its deficiencies. Thus in Clay U.S. Pat. No. 4,111,727, it is suggested that a water-in-oil emulsion be used to partially fill the interstices between the solid granules; however, in some cases this is not as highly water resistant as may be needed. Water-in-oil emulsions to be used as explosives per se have been described by Bluhm in U.S. Pat. No. 3,447,978, also in British Pat. No. 1,306,546. Egly et al, in U.S. Pat. No. 3,161,551 has suggested use of an emulsion to fill around ammonium nitrate prills but made no provision for sensitivity and such compositions usually fail to detonate. In a copending application, Ser. No. 936,926, filed Aug. 25, 1978, the present applicant has suggested that an emulsion be used to fill all the voids and that gas-containing hollow microspheres be included to impart sensitivity.

According to the present invention, a filler material is also used but it is one which can be better controlled as to sensitivity. It contributes substantial energy and does not adversely affect the solid particles of ammonium nitrate which make up the main bulk of the charge. It is based on the discovery that certain non-aqueous types of slurry can partially fill the interstices and pores in and between the granules without softening or partly dissolving the granules themselves. This maintains good consistency as well as good sensitivity of the combined solid granules and slurry. The slurries used for this purpose, according to my invention, are based on organic liquid solutions of ammonium and/or calcium nitrate, with or without some other salts, wherein the solvent is a polar liquid, a low molecular weight organic liquid compatible with water and having reasonably good solvency for the nitrates, along with other powerful oxidizer salts, selected from the group which consists of methanol, ethylene glycol, formamide and ethanol. In some cases isopropanol and/or propylene glycol can be used as part of the solvent. As much salt as is practical should be dissolved in the solvent for maximum benefit.

By the present invention, major disadvantages of the prior art reinforced ANFO compositions can be avoided while still retaining most of their advantages.

Objectives and advantages of the present invention and of products made according to it are listed as follows:

(1) A blasting agent of superior bulk energy is made available, still based largely on the use of relatively inexpensive fertilizer grade ammonium nitrate. Compared to ANFO with a relative bulk strength of 1.0, the bulk energy of the improved compositions may be increased and may be controlled over a rather wide range from 1.0 to as much as 1.5. The weight energy (blasting energy per unit of weight) can be at least substantially equal to that of ANFO, thus permitting equivalent blasting with smaller and less expensive boreholes.

(2) Where it is desired to have a detonation velocity lower than that of some of the older conventional blasting agents, for lower fragmentation and more heaving action, this improved composition can have definite advantages. With them, lower velocities may be obtained without substantial loss of power. In situations where extra energy is desirable, and where fuel particles such as coarsely divided aluminum are added to obtain the extra energy the longer reaction time thus provided also can result in fuller combustion of the fuel particles and therefore better utilization of such fuels. This applies not only to aluminum fuels but to other particulate fuels as well.

(3) According to the present invention, the blasting agent can be prepared at relatively low cost, compared to other agents of similar energy. With substantially higher density then ANFO, and consequent higher bulk energy, it can be made denser than water so as to sink readily into water filled boreholes. For this purpose, it may be bagged in water-proof containers which usually is considered necessary in such cases. Although some success has been obtained in increasing density of normal ANFO, e.g. by adding fines, etc., the density thus obtainable is usually not sufficient to have the material sink readily into water. Rapid sinking can be obtained with the present improved products.

(4) The agents of this invention can readily be delivered, at variable and controlled density, from modified or even conventional ANFO delivery trucks.

(5) For very deep holes, where extra blasting strength may be needed at the bottom, dependable blasting compositions of higher density, and consequent greater bulk energy, can be delivered to the bottom of the hole while those of lesser density and lower cost can be used towards the top where less energy is required.

(6) The agents of the present invention can be made in most parts of the world from locally available materials.

(7) The compositions are quite insensitive to inadvertent or unintentional detonation due to external causes over a wide temperature range.

(8) The agents are also insensitive to sparks, shocks in handling, rifle bullets or blasting caps.

(9) No complicated special equipment is needed, either for preparation or for delivery at borehole sites.

(10) These compositions can readily be cleaned up and spills removed by simple washing with water.

(11) They can be safely stored at a plant or in a delivery truck. They are safe and stable over long periods of time and under various environmental conditions.

(12) At the same time, they are reliably detonable by standard booster type detonators.

It has been known in the past to use organic liquids such as those mentioned above as fuel in slurries per se but in the present case, they are used also as primary solvents. Thus advantage is taken of their fuel values while avoiding the disadvantages of aqueous slurry in combination with ANFO. A good example of prior art use of these organic liquids in slurries is found in Funk et al U.S. Pat. No. 3,765,967, where they are described as being useful in small diameter charges, provided they can be detonated. To insure detonation, this reference suggests incorporation of self-explosives and contemplates use of perchlorates in the oxidizers. It is preferable to avoid use of such materials for safety reasons, not to mention expense; they are not needed in the present invention.

SUMMARY OF THE INVENTION

The invention may be described in summary as being a plastic or pourable but predominantly solid composition of strong blasting power, consisting of 60 to 90 parts by weight, based on the total, of particulate oxidizer salt of which at least a major part is ammonium nitrate. The remainder may be other solid particulate oxidizer and/or particulate fuel or a liquid fuel such as oil fuel which coats the particles of oxidizer without significantly dissolving them. The interstices of the forementioned major component are partially filled with 10 to 40% by weight of a liquid, preferably viscous gelled liquid solution wherein the solvent is an organic liquid of relatively low molecular liquid with strong oxidizer salt dissolved in it. The particulate salt comprises the major part of the composition. The liquid portion is essentially inert towards the particulate salts, that is, it does not appreciably dissolve them. It is selected from those organic solvents which have reasonably good solvency for ammonium and/or calcium nitrate, though less solvency than water, selected from the group which consists of the lower molecular weight aliphatic alcohols, the lower aliphatic diols and the lower aliphatic organic amines. Specifically, the solvents are preferably selected from the group which consists of methanol, ethylene glycol, formamide and ethanol, in that order. In some cases, propanol, especially isopropanol may be used or propylene glycol, and any two or more of these may be mixed together and used as solvent for the strong oxidizer. The latter may contain minor proportions of sodium nitrate and/or one of the sensitive and powerful chlorates or perchlorates which are conventionally used in explosive compositions of this type.

The proportions of the various ingredients may be varied somewhat, but the solution should be substantially saturated, and may be supersaturated at the temperature of storage or use, so that the solvent will not appreciably dissolve the particulate solids it is mixed with.

Compositions according to the present invention may also include other known or conventional additives and/or modifiers, such as finely divided solid fuels, e.g. finely ground aluminium, or carbon, such as ground coal or gilsonite, sugar, and/or other carbonaceous solids or liquids. It may also contain structural stabilizers such as cross linking agents for the thickener, as where guar gum, for example, is used to thicken the liquid. The invention will be more fully understood by referring to the detailed description of preferred embodiments which follows.

DESCRIPTION OF PREFERRED EMBODIMENTS

Reference will first be made to the single FIGURE of drawing which is attached hereto. It shows the relative solvency of water and various low molecular weight organic liquids for ammonium nitrate. Solubilities of other nitrates are analogous. For reasons of economy, the prilled ammonium nitrate, as prepared for use as agricultural fertilizer, is a preferred solid oxidizer. It will be noted that water is the most effective solvent, in terms of weight nitrate salt dissolved over a reasonable and convenient range of temperatures. Next to water, formamide, ethylene glycol, methanol and ethanol follow in that order. The solvency of ethanol for nitrates is somewhat marginal; for these reasons the other organic solvents listed are usually preferred but ethanol can be used satisfactorily in many cases. All of these organic solvents have a flatter temperature gradient than water and at temperatures well below the freezing point of water, some of them may actually have higher solvency than water. They are thus advantageous for use at low temperatures, as is known in the prior art mentioned above and they have been used as antifreeze agents in some cases in the past. For purposes of the present invention, however, they are preferred over water because solutions based on them can be used to partially fill the interstices and pores in solid granules or prills of AN and the like without dissolving or softening AN.

As noted above, the use of organic solvents with oxidizer salts in slurries is not novel per se. U.S. Pat. No. 3,765,967, mentions the fact that methanol, ethylene glycol, formamide and the like are solvents for AN and that they can have utility as fuels in explosive slurries. Their low temperature properties are well known, as is also their fuel value. There are other prior art disclosures of slurries which contain ethylene glycol, formamide, etc., but most of them refer to compositions where the liquid phase (albeit a thickened liquid) is predominant, or at least is continuous. In the present invention, the slurry or thickened liquid component is discontinuous, being rather a filler and a densifying agent for essentially solid granular compositions especially those based on fertilizer grade ammonium nitrate prills to which oil or equivalent fuel may be added. That is, the composition of the present invention is basically a plastic solid mass that can be augured or otherwise conveyed through a conduit and usually is not liquidic. The liquid filler mass is only a minor proportion of the whole and serves to add density and to improve water resistance and blasting power to a conventional particulate solid blasting composition.

The liquid or slurry filler of the present invention may be made up in various ways. It is based preferably on a polar organic solution of powerful oxidizer. Ammonium nitrate and calcium nitrate are preferred salts although other nitrates or even perchlorates may be present. The filler liquid may include finely divided particulate fuels in suspension, such as finely divided aluminum, coal, gilsonite, etc., as mentioned above and/or it may contain other liquid fuels, including mineral and non-mineral oils. The latter may include aliphatic or aromatic hydrocarbons, vegetable oils, fish oils or other animal fats and oils as fuels. These may comprise various kinds and grades of mineral oil, including reclaimed motor oil. For holding the slurry in place in the mixture as well as preventing bleeding, etc., a thickening agent is added; this also assists in suspending fine particulates in the liquid. The whole composition is stable enough to endure the usual and necessary storage under different environmental conditions. For this purpose, conventional mechanical and/or chemical stabilizers may be added, as needed.

Under the general concept described above, numerous compositions have been made and tested by the present inventor. Some of them were stable when first made, and some remained stable in storage for months. However, many of them, especially those which contained significant quantities of water, eventually softened the ammonium nitrate prills or converted the prilled oxidizer into a caked rigid mass, with considerable loss of sensitivity. In some cases this loss of sensitivity could be tolerated; in others, especially where long time storage was expected, it was found that the compositions containing no water were better.

Considering the solubility of ammonium nitrate and associated salts in the various solvents, as seen in the drawing, the density of the final composition may be increased effectively by dissolving as much oxidizer as possible in the solvent. Considerations of economy may limit the choice of solvent; methanol is usually the least expensive of those preferred above. Although somewhat more expensive in most cases than methanol, ethylene glycol is often a good choice because of its superior solvency and good fuel value. By using such a solution, or slurry, of high specific gravity, the relatively low bulk density of conventional ANFO may be considerably increased with relatively small quantities of the liquid component.

It is also desirable that the slurry composition have a low "fudge" or crystal precipitation point so that the slurry will be flowable at quite low temperatures. This helps to maintain sensitivity to detonation at all temperatures likely to be encountered in the field.

Obviously, the solid components, such as prilled AN (which may include other oxidizer salts) should be as insoluble in the slurry component as can be managed. Any significant dissolving of AN prills, for example, may contribute a two-fold disadvantage. Extra AN dissolved in the slurry will increase the density of the liquid component and/or will decrease its salt proportions therein both of which may contribute to desensitization of the composition for detonation. Solution of salt from the solid component will soften the rigid supporting prills allowing a decrease in the voids, gas pockets, or "ignition" points that are needed for proper sensitivity. This may lead to a requirement for larger or more expensive detonators or may produce a composition that cannot reliably be detonated at all.

Because of its reasonable cost, methanol is a good starting liquid and if calcium nitrate is to be used along with the AN, it is particularly suitable, since it has good solvency for the latter. Calcium nitrate, in a commercially available form ("Norsk Hydro CN") contains about 5% of AN and includes about 15% by weight of water of crystallization; the latter aids in dissolving both the calcium nitrate and the ammonium nitrate. With respect to temperature, the methanol solvency chart is relatively flat, a further advantage. By saturating the methanol with AN, or with a mixture of AN and the commercial grade CN mentioned, the phase stability of the solution becomes very satisfactory.

The following Table I shows three solutions wherein methanol, ethylene glycol and water, respectively, were used as solvents. The First, solution A, comprises about 30% by weight of methanol, 60% of "Norsk Hydro CN" and about 10% of commercial ammonium nitrate, along with 0.6% of a cellulose gum as a thickener or gelling agent. Such a solution can be made at room temperature, stirring the salts first into the solvent and then adding the thickener. The thickened solution has a density of about 1.4 g./cc. It has very low solubility for any additional AN, so it does not appreciably attack the prills in the solid state. At the same time, it does not crystallize its own salts out at a temperature as low as −35° C.

TABLE I

| | Solution: A (Methanol) | B (Ethylene glycol) | C (Water) |
|---|---|---|---|
| Ammonium Nitrate, % by wt. of solution | 10 | 10 | 32 |
| Norsk Hydro CN (80% CN, 15% $H_2O$, 5% AN) | 60 | 40 | 50 |
| Sodium Nitrate % | 0 | 0 | 6 |
| Water % | — | — | 12 |
| Ethylene Glycol % | — | 50 | — |
| Methanol % | 30 | — | — |
| Hydroxyethyl Cellulose | 0.6 | — | — |
| Hydroxypropyl Guar | — | 0.6 | 0.6 |
| Density, gm./cc. | 1.4 | 1.4 | 1.6 |
| Crystallization point, °C. | 35 | 35 | 10 |

Solution B in the table was made with ethylene glycol as solvent; however, it required heat to dissolve the crystals in the proportions shown. Some salt crystals also precipitated out as the solution cooled towards room temperature.

Solution C used water as solvent. The resulting density was high and the crystallization temperature relatively low, but heat was required to dissolve the salts in the proportions shown. The guar gum thickener produced a cross-linked gel structure which was found very difficult to mix into the prilled AN. Apparently the calcium ion in the calcium nitrate cross-links the solution almost immediately.

Numerous blasting compositions were made, using all the solutions of Table I in combination with AN, ANFO and other solid oxidizers, also in some cases including sodium nitrate (SN), and with various fuels. Table II shows eleven different compositions, the last example being conventional ANFO (94% AN, 6% fuel oil). Solutions A, B and C contained the solvents methanol, ethylene glycol and water, respectively.

TABLE II

| Mix No. | 1 | 2 | 3 | 4 | 5 | 6 | 7 | 8 | 9 | 10 | 11 |
|---|---|---|---|---|---|---|---|---|---|---|---|
| Solution A, % | 20 | 25 | 30 | 20 | 20 | 20 | 20 | 20 | — | — | — |
| Solution B | | | | | | | | | 20 | | |
| Solution C | | | | | | | | | | 25 | |
| Oxidizer Comp. | | | | | | | | | | | |
| AN wt. % | 76 | 73 | 67.5 | 76 | 73 | — | 60 | 73 | 78 | 69 | 94 |
| SN wt. % | | | | | | | 15 | | | | |
| Dense AN % | | | | | | 78 | | | | | |
| Added Fuels: | | | | | | | | | | | |
| Fuel Oil, % | 4 | 3 | 2.5 | | | | 5 | 2 | 2 | 6 | 6 |
| Gilsonite | | | | 4 | | | | | | | |
| Atomized Al. | | | | | | 2 | | 5 | | | |
| Methanol | | | | | 7 | | | | | | |
| Approx. Oxygen Balance, % | −2 | 0 | 0 | −1 | 0 | +10 | −1 | 0 | 0 | +1 | −1 |
| Density, g./cc. | 1.1 | 1.18 | 1.18 | 1.13 | 1.13 | 1.15 | 1.3 | 1.2 | 1.08 | 1.23 | 1.00 |
| Wt. Strength | 0.99 | 0.98 | 0.98 | 0.99 | 0.98 | — | 0.97 | 1.2 | 0.98 | 0.92 | 1.00 |
| Bulk Strength | 1.33 | 1.41 | 1.41 | 1.35 | 1.35 | — | 1.54 | 1.76 | 1.29 | 1.38 | 1.00 |
| Rel. Ingredient Cost | 1.04 | 1.05 | 1.05 | 1.04 | 1.05 | — | 1.12 | 1.28 | 1.86 | 1.01 | 1.00 |
| Shooting Results at 20° C. with ½lb. Boosters | | | | | | | | | | | |
| 3" diam × 18" | — | — | — | F[1] | D[2] | — | F | D | — | D | F |
| 4" diam × 24" | D | — | D | D | D[3] | F | F | — | D | — | D |
| 5" diam × 30" | — | D | — | — | — | D | D[4] | — | — | — | — |

Notes:
F indicates some of charge failed;
D indicates complete detonation;
superscript 2 indicated with cratering;
3 indicates detonation vel. 3000m./sec.;
4 indicates detonation vel. 2500m./sec.

Various gums are available for thickening methanol solutions, as well as for the other solutions shown. Hydroxy alkyl celluloses such as hydroxy ethyl cellulose is suitable and other gums, as well as "cabosils" (finely divided silicate powders obtainable from Cabot Co.), can be used as thickeners. Mix No. 6, Table II, in which a dense agricultural ammonium nitrate prill fertilizer was used as the solid dry oxidizer detonated satisfactorily, even though it was not well oxygen balanced. The fine atomized aluminum used in this composition provided the extra sensitivity needed.

The solutions which used methanol and/or ethylene glycol (A and B) were more stable and showed better shelf life than those based on water. By adding as much oxidizer to the solvent as is practicable, the slurry density is maximized and it can be used in lesser quantities than required for filling the voids and interstices in the granules, thus leaving some unfilled voids which will enhance sensitivity.

Where fuel oil is included, it may be either premixed with the particles (prills) before adding the slurry solution or it may be mixed into the solution and emulsified or suspended therein, for adding to the solid component. By varying the amount of solution or slurry, the bulk strength of the final composition as well as its sensitivity can be well controlled. Bulk strength can be as much as 1.5, based on standard ANFO as 1.0, and this without addition of other fuels such as relatively costly atomized aluminum. Thus an economical as well as a powerful explosive can be produced. By selectively included special fuels, the products of this invention may be tailored to almost any reasonable specification.

It will be obvious to those skilled in the art that various combinations of oxidizers, solvents, fuels and other modifiers may be used, in various proportions, and that other modifications may be made within the spirit and purpose of the present invention. It is intended by the claims which follow to cover these as broadly as possible, in view of the state of the prior art.

What is claimed is:

1. A blasting agent having a bulk density above 1.0 grams per cc. of generally solid or plastic solid consistency, based largely on particulate ammoniun nitrate, which comprises, in combination:

(a) 60 to 90% by weight, based on the total, of solid particulate oxidizer sale which includes ammonium nitrate, and (b) 10 to 40% by weight of a thickened liquid component comprising a nitrate oxidizer salt dissolved in a polar organic solvent selected from the group which consists of methanol, ethylene glycol and, said solution being substantially fully saturated by said salt and only partially filling the interstices in component (a) to provide for sensitizing the overall composition to detonation by standard detonating devices.

2. A composition according to claim 1 in which the solvent is methanol and in which a major proportion of the particulate solid is ammonium nitrate.

3. A composition according to claim 1 in which the solution contains a mixture of ammonium nitrate and calcium nitrate.

4. A composition according to claim 1 which includes a finely divided solid fuel.

5. A composition according to claim 4 in which the fuel comprises finely divided aluminum.

6. A composition according to claim 1 which includes finely divided aluminum in the solution.

7. A composition according to claim 1 in which the solvent comprises ethylene glycol.

8. A composition according to claim 1 in which the solvent is methanol.

9. A composition according to claim 1 in which the solvent comprises methanol and is thickened to a gel consistency with hydroxy ethyl cellulose.

10. A composition according to claim 1 in which the solid particulate salt is predominantly fertilizer grade ammonium nitrate, which includes fuel oil to improve oxygen balance, and in which the liquid component is a substantially saturated solution of ammonium nitrate and calcium nitrate in a polar organic solvent selected from the group which consists of methanol and ethylene glycol.

11. A composition according to claim 10 in which the solvent is methanol and the solution is thickened to a gel consistency with a hydroxy ethyl cellulose, the solution substantially but not completely filling the interstices between granules to enhance sensitivity by inclusion of air pockets in the composition.

12. Composition according to claim 10 in which the solvent is ethylene glycol.

13. Composition according to claim 10 which includes finely divided aluminum as a fuel and sensitizer.

14. Composition according to claim 10 which contains methanol as a solvent, a hydroxy ethyl cellulose as a thickener for the solution, and finely divided fuel particles suspended in the solution.

* * * * *